US006321853B2

(12) United States Patent
Giardino et al.

(10) Patent No.: US 6,321,853 B2
(45) Date of Patent: Nov. 27, 2001

(54) VIBRATION ISOLATED IMPACT WRENCH

(75) Inventors: David A. Giardino, Rock Hill, SC (US); Ronnie G. Foltz, Charlotte, NC (US)

(73) Assignee: Chicago Pneumtic Tool Company, Rock Hill, SC (US)

( * ) Notice: Subject to any disclaimer, the term of this patent is extended or adjusted under 35 U.S.C. 154(b) by 0 days.

(21) Appl. No.: 09/746,327

(22) Filed: Dec. 21, 2000

Related U.S. Application Data

(62) Division of application No. 09/410,915, filed on Oct. 1, 1999.

(51) Int. Cl.[7] ..... B25D 15/00

(52) U.S. Cl. ..... 173/1; 173/93; 173/93.5; 173/211

(58) Field of Search ..... 173/93, 93.5, 93.6, 173/109, 104, 210, 211, 162.2, 1

(56) References Cited

U.S. PATENT DOCUMENTS

| | | | | |
|---|---|---|---|---|
| 3,156,334 | * | 11/1964 | Hoza | 173/93 |
| 3,169,585 | * | 2/1965 | Maurer | 173/93 |
| 3,179,219 | * | 4/1965 | Karden | 173/93.5 |
| 3,294,183 | | 12/1966 | Riley, Jr. et al. . | |
| 3,557,884 | | 1/1971 | Allen . | |
| 3,804,180 | | 4/1974 | Gelfand et al. . | |
| 3,908,768 | | 9/1975 | Hess . | |
| 3,968,843 | | 7/1976 | Shotwell . | |
| 4,243,108 | | 1/1981 | Galimov et al. . | |
| 4,450,921 | | 5/1984 | Arvidsson et al. . | |
| 4,476,941 | | 10/1984 | Buck et al. . | |
| 4,509,669 | | 4/1985 | Elliesen . | |
| 4,592,431 | | 6/1986 | Tornqvist . | |
| 4,776,408 | | 10/1988 | Elkin et al. . | |
| 4,817,736 | * | 4/1989 | Ono | 173/93.5 |
| 5,054,562 | | 10/1991 | Honsa et al. . | |
| 5,083,619 | * | 1/1992 | Giardino et al. | 173/93.5 |
| 5,269,733 | | 12/1993 | Anthony, III . | |
| 5,322,131 | | 6/1994 | Pressley et al. . | |
| 5,407,018 | | 4/1995 | Henry . | |
| 5,417,294 | | 5/1995 | Suher . | |
| 5,441,192 | | 8/1995 | Sugita et al. . | |
| 5,485,887 | | 1/1996 | Mandanis . | |
| 5,573,075 | | 11/1996 | Henry et al. . | |
| 5,626,199 | | 5/1997 | Henry et al. . | |
| 5,813,477 | | 9/1998 | Clay et al. . | |
| 5,836,401 | | 11/1998 | Hsiu-Tsu . | |
| 5,848,655 | | 12/1998 | Cooper et al. . | |
| 5,884,828 | | 3/1999 | Hirtl et al. . | |

* cited by examiner

*Primary Examiner*—Scott A. Smith
(74) *Attorney, Agent, or Firm*—Schmeiser, Olsen & Watts

(57) ABSTRACT

This invention relates generally to an impact tool. The present invention provides a vibration isolated impact tool wherein an impact mechanism and a motor assembly are arranged into a cartridge assembly. An elastomeric member resiliently connects the cartridge assembly with a housing. The cartridge assembly is free to move axially and rotationally within the housing. The elastomeric member absorbs axial vibration and torsional vibration, reducing the vibration transmitted to an operator.

10 Claims, 4 Drawing Sheets

VIBRATION ISOLATED IMPACT WRENCH

This application is a divisional of Ser. No. 09/410,915, filed on Oct. 1, 1999, pending.

FIELD OF THE INVENTION

The present invention relates generally to impact tools and, more particularly, to an impact wrench including vibration isolation.

BACKGROUND OF THE INVENTION

Impact tools such as impact wrenches are well known in the art. Generally, the impact tools include an air motor and a clutch mechanism. Typically, the impact tool transmits shock and vibration from the tool head to the handle. In turn, the shock and vibration is transmitted from the handle to an operator holding the handle.

SUMMARY OF THE INVENTION

The present invention provides a vibration isolated impact tool wherein an impact mechanism and a motor assembly are arranged into a cartridge assembly. An elastomeric member resiliently connects the cartridge assembly with a housing. The cartridge assembly is free to move axially and rotationally within the housing. The elastomeric member absorbs axial vibration and torsional vibration, reducing the vibration transmitted to an operator.

The present invention generally provides an apparatus comprising: a housing; an impact mechanism generating an axial force and a torsional force; a motor for rotating the impact mechanism; and an elastomeric member connecting the impact mechanism and the motor with the housing, and wherein the elastomeric member is attached such that the elastomeric member absorbs both axial and torsional forces. This aspect provides for a vibration isolated impact tool that reduces the axial and torsional forces received by the user of the tool.

The second aspect in accordance with the present invention provides a method comprising the steps of: providing a housing; providing a cartridge assembly including a motor and an impact mechanism; slidably receiving the cartridge assembly into the housing; and providing an elastomeric member connecting the cartridge assembly with the housing, wherein the elastomeric member absorbs axial and torsional vibrational forces. The second aspect provides similar advantages to those of the first aspect.

The third aspect in accordance with the present invention provides a cartridge, slidably received within a housing of an impact tool, comprising: a motor, having a first end adapted to be coupled to an elastomeric member; an impact mechanism, generating an axial force and a torsional force, having a first end operatively coupled to a second end of the motor; and an anvil operatively coupled to a second end of the impact mechanism. This aspect provides similar advantages to those of the first aspect.

The fourth aspect in accordance with the present invention provides an elastomeric member, resiliently mounted within a housing of an impact tool, comprising a first surface adapted to be coupled to a motor, a second surface adapted to be coupled to the housing of the impact tool, and means for attachment for allowing the elastomeric member absorb axial and torsional forces created within the impact tool. This aspect provides similar advantages as those in the first aspect.

The foregoing and other features and advantages of the invention will be apparent from the following more particular description of preferred embodiments of the invention.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
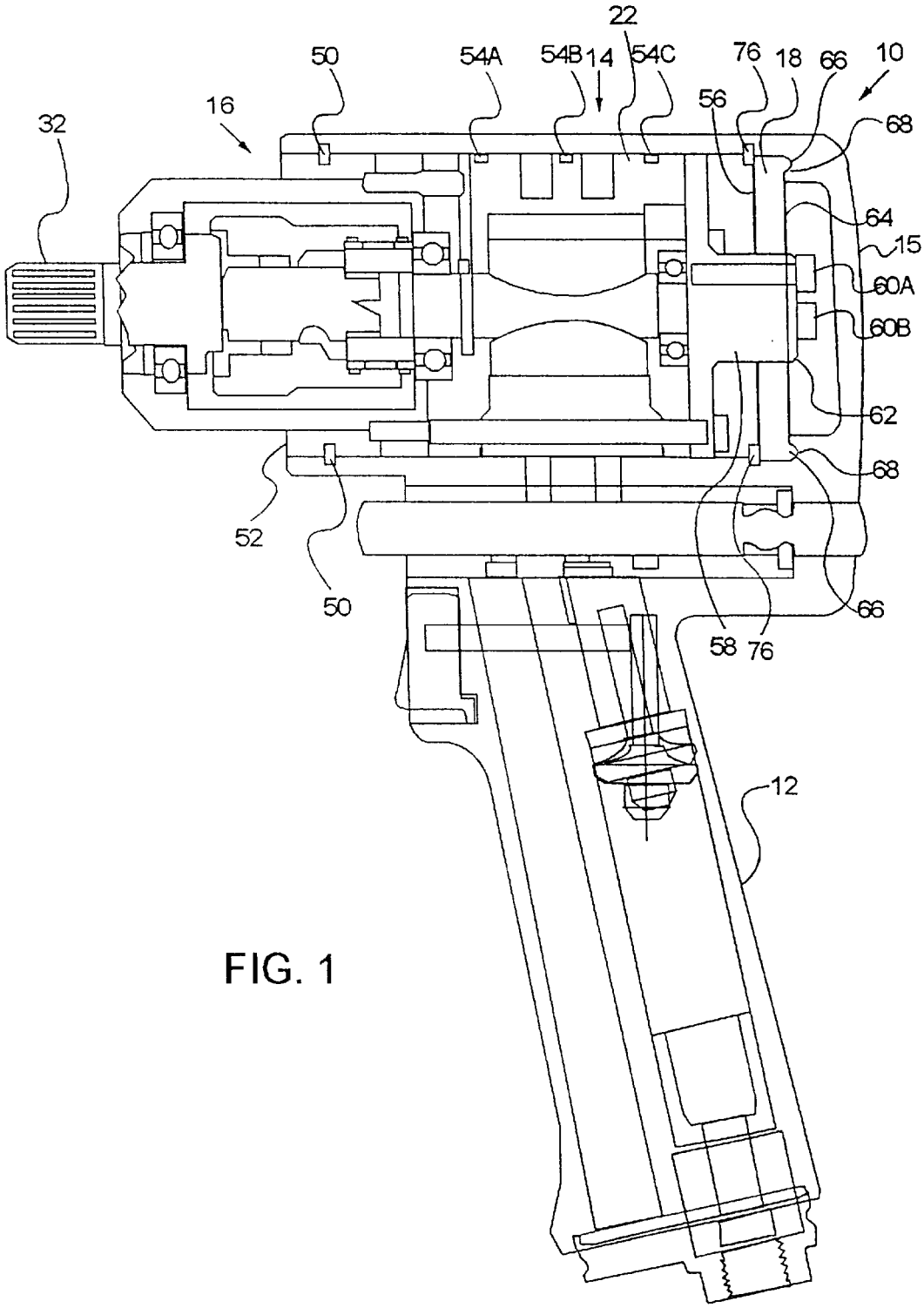
FIG. 1 illustrates a cross-sectional view of an impact tool, in accordance with a preferred embodiment of the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

Referring to FIG. 1, there is a cross-sectional view of a tool 10 depicted, including generally, a handle 12 fixedly mounted to a housing 14. A cartridge assembly 16 is slidably received within housing 14. An elastomeric member 18 is resiliently mounted within the rear of housing 14.

Figure 2:
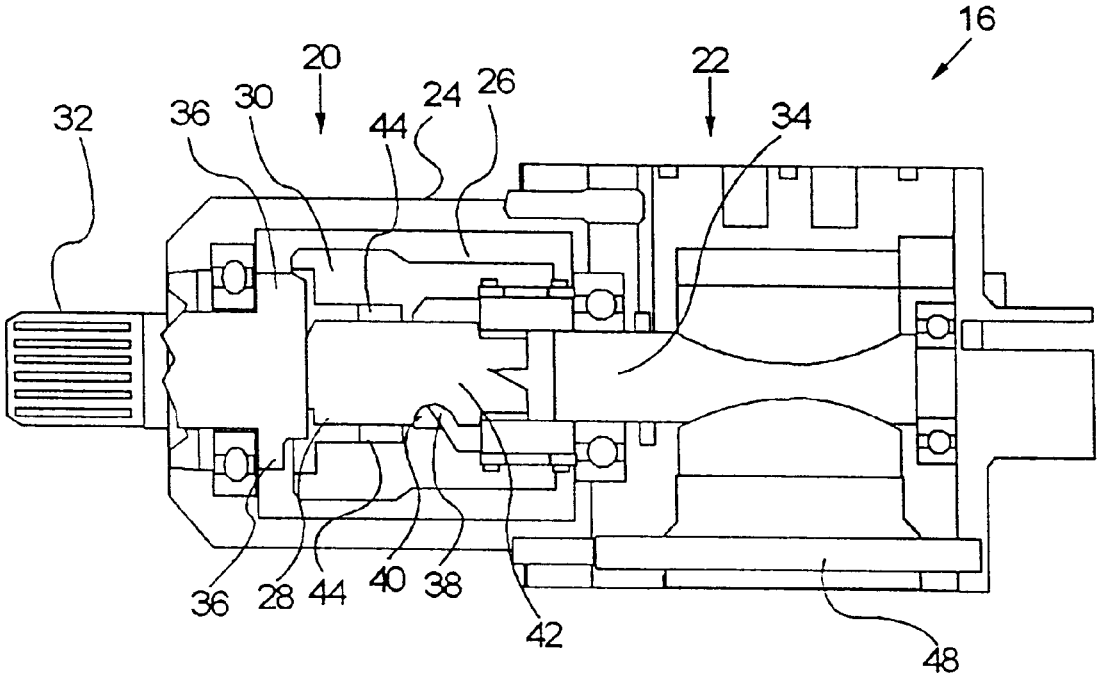
FIG. 2 illustrates a cross-sectional view of a cartridge assembly.
Figure 5:
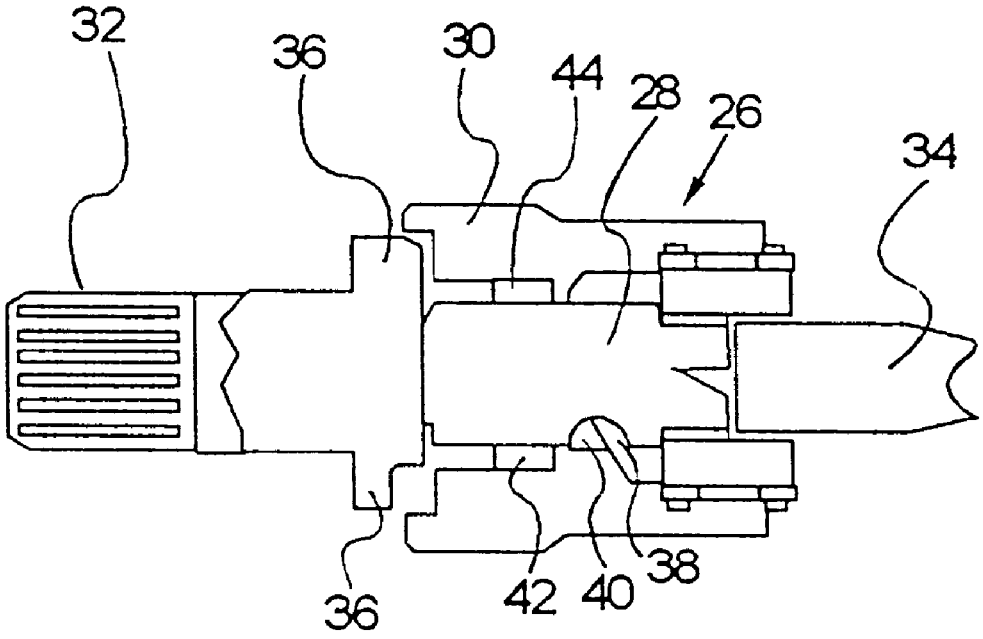
FIG. 5 illustrates a cross-sectional view of an impact mechanism.

FIG. 2 illustrates a cross-sectional view of cartridge assembly 16, which includes an impact mechanism or generator 20 and a motor assembly 22. Impact generator 20, contained within an impact generator housing 24, includes a clutch mechanism 26, (FIGS. 2 and 5), a timing shaft 28, a dog hammer 30 and a power output shaft or anvil 32. Anvil 32 includes at least two rearwardly projecting lobes 36 which receive the axial impact transmitted from dog hammer 30. Rotational energy is transmitted from an output shaft 34 to dog hammer 30, which impacts anvil 32. The anvil 32 is depicted as a spline, but may be various shapes, such as hex or square.

Timing shaft 28 includes a ball engaging track 38. Similarly, dog hammer 30 includes a ball engaging track 40. A ball 42 follows ball engaging tracks 38 and 40 of timing shaft 28 and dog hammer 30, respectively. Timing of the impacts is determined by the relationship of ball engaging tracks 38 and 40. Dog hammer 30 moves in an axial direction to strike lobes 36 of anvil 32, which is subsequently returned to a non-impact position relative to dog hammer 30 by a spring 44. Axial and torsional forces generated by clutch mechanism 26 are transmitted through anvil 32.

FIG. 2 also depicts motor assembly 22 including output shaft 34 which supplies the rotational motion to clutch mechanism 26. Motor assembly 22 is air powered, but can be powered by any other suitable means, such as, electric, hydraulic, gas, etc. Air is provided to motor assembly 22 via an air inlet port 48.

Figure 3:
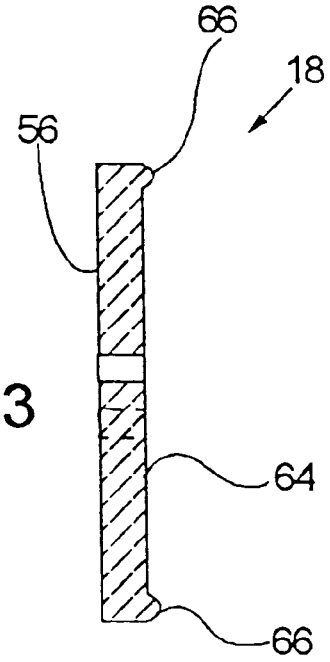
FIG. 3 illustrates a cross-sectional view of an elastomeric member.
Figure 4:
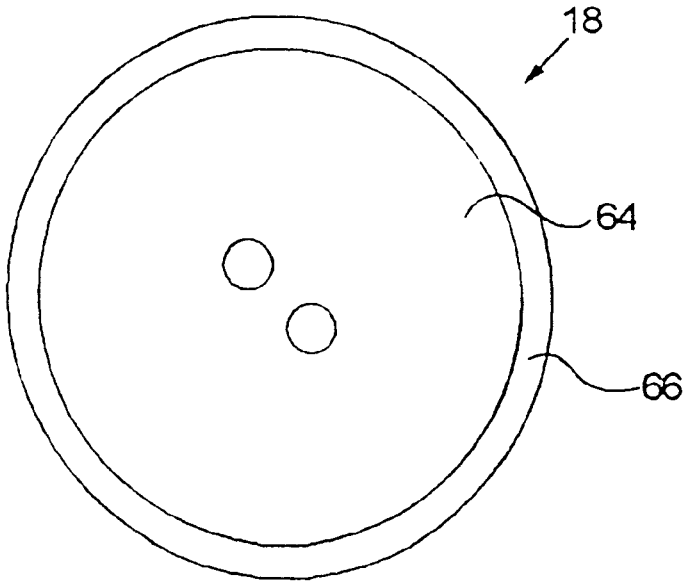
FIG. 4 illustrates a front view of the elastomeric member.

FIG. 3 depicts a cross-sectional view of elastomeric member 18, while FIG. 4 depicts a front view of elastomeric member 18. Referring also to FIG. 1, a first side 56 of elastomeric member 18 is attached to a rear attachment plate 58 of motor assembly 22 using a plurality of fasteners 60 (two are shown as 60A, 60B). A plate 62 is located between fasteners 60A, 60B and a second side 64 of elastomeric member 18. A raised portion 66 of second side 64 of elastomeric member 18 is received in a recessed portion 68 of the rear cover 15 of housing 14. Raised portion 66 of elastomeric member 18 is held within recessed portion 68 of rear cover 15 by a stop 76. The raised portion 66 increases the surface area and thus the frictional force for prevent slippage of the elastomeric member. Elastomeric member 18 absorbs both axial and torsional vibration generated by cartridge assembly 24. This reduces the vibration transmitted through housing 14 to handle 12, and ultimately to the operator. An advantage of elastomeric member 18 is the ease of replacement by removal of rear cover 15, and fastens 50A, 60B.

Elastomeric member 18 is preferably made of neoprene rubber for durability, but may be made from any suitable dampening material, such as, polyurethane, rubber, neoprene rubber, etc. It should be noted that the shape and size of elastomeric member 18 may be varied to alter the torsional versus axial rigidity of elastomeric member 18 as needed for particular applications. Therefore, the size and shape of elastomeric member 18 are not limited by the preferred embodiment. For instance, elastomeric member 18 does not have to have raised portion 66. Likewise, the fastening means by which elastomeric member 18 is secured within rear attachment plate 58 is not limited by the preferred embodiment. For instantce, elastomeric member 18 may be fastened to rear attachment plate 58 via glue, etc., not requiring stop 76.

As in FIG. 1, cartridge assembly 16 is free to move both axially and rotationally within housing 14. A stop 50, also depicted in FIG. 1, prevents cartridge assembly 16 from sliding through the front opening 52 of housing 14. A plurality of seals 54A, 54B, and 54C prevent air from leaking beyond motor assembly 22.

It should also be noted that the present invention was described utilizing a clutch mechanism 26, but it is not limited to the use of a clutch.

The foregoing description of the present invention has been presented for purposes of illustration and description. It is not intended to be exhaustive or to limit the invention to the precise form disclosed, and many modifications and variations are possible in light of the above teaching. Such modifications and variations, that may be apparent to a person skilled in the art, are intended to be included within the scope of this invention as defined by the accompanying claims.

We claim:

1. An apparatus comprising:

a housing;

an impact mechanism generating an axial force and a torsional force;

a motor for rotating the impact mechanism; and an elastomeric member connecting the impact mechanism and the motor with the housing, and wherein the elastomeric member is attached such that the elastomeric member absorbs both axial and torsional forces.

2. The apparatus of claim 1, further including a cartridge assembly which includes the motor and the impact mechanism, and wherein the cartridge assembly is slidably received into the housing.

3. The apparatus of claim 1, wherein the housing further includes a handle for an operator to grasp.

4. The apparatus of claim 1, wherein the motor generates torsional forces.

5. The apparatus of claim 1, wherein the impact mechanism comprises:

an anvil including at least two lobes;

a timing shaft operatively coupled to the anvil;

a dog hammer impacting the lobes on the anvil;

a means for timing the impact between the dog hammer and the lobes on the anvil.

6. The apparatus of claim 1, wherein the elastomeric member is neoprene rubber.

7. The apparatus of claim 1, wherein the cartridge assembly further includes a rear plate and a rear attachment plate attached to the motor.

8. The apparatus of claim 7, wherein the elastomeric member is secured between a rear cover of the housing and a stop attached within the housing.

9. The apparatus of claim 1, wherein an outer portion of the elastomeric member further includes a raised portion.

10. A method comprising the steps of:

providing a housing;

providing a cartridge assembly including a motor and an impact mechanism;

slidably receiving the cartridge assembly into the housing; and providing an elastomeric member connecting the cartridge assembly with the housing, wherein the elastomeric member absorbs axial and torsional vibrational forces.

* * * * *